US009180678B2

(12) United States Patent
Inada

(10) Patent No.: US 9,180,678 B2
(45) Date of Patent: Nov. 10, 2015

(54) RECORDING HEAD

(71) Applicant: CANON KABUSHIKI KAISHA, Tokyo (JP)

(72) Inventor: Genji Inada, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/171,604

(22) Filed: Feb. 3, 2014

(65) Prior Publication Data

US 2014/0218449 A1 Aug. 7, 2014

(30) Foreign Application Priority Data

Feb. 4, 2013 (JP) ..... 2013-019353

(51) Int. Cl.
*B41J 2/19* (2006.01)
*B41J 2/14* (2006.01)

(52) U.S. Cl.
CPC ..... *B41J 2/19* (2013.01); *B41J 2/14145* (2013.01); *B41J 2202/07* (2013.01)

(58) Field of Classification Search
CPC ..... B41J 2/19
USPC ..... 347/92
See application file for complete search history.

(56) References Cited

U.S. PATENT DOCUMENTS

| | | | | |
|---|---|---|---|---|
| 5,777,649 | A * | 7/1998 | Otsuka et al. | 347/94 |
| 6,557,989 | B1 * | 5/2003 | Hirosawa et al. | 347/87 |
| 6,976,754 | B2 * | 12/2005 | Ohashi et al. | 347/92 |
| 2002/0033868 | A1 * | 3/2002 | Ohashi et al. | 347/92 |

FOREIGN PATENT DOCUMENTS

JP 2004-122463 A 4/2004

* cited by examiner

*Primary Examiner* — Alessandro Amari
*Assistant Examiner* — Michael Konczal
(74) *Attorney, Agent, or Firm* — Canon USA Inc. IP Division

(57) ABSTRACT

A recording head includes an ejection portion configured to eject ink, a first flow path forming member and a second flow path forming member joined to each other between which a flow path for supplying ink to the ejection portion, a buffer chamber for keeping gas, and a communication passage between the flow path and the buffer chamber are formed, a through-hole formed on the second flow path forming member configured to penetrate the second flow path forming member to open onto a surface on an opposite side of a joint surface facing the first flow path forming member, and a communication port formed at a position facing an interior of the buffer chamber, configured to communicate with the through-hole, wherein the communication port is arranged at a position higher than a wall of a top surface that constitutes a communication passage in a usage state of the recording head.

6 Claims, 9 Drawing Sheets

RECORDING HEAD

BACKGROUND OF THE INVENTION

1. Field of the Invention

The present invention relates to a recording head that has a buffer chamber, and ejects ink.

2. Description of the Related Art

An image forming apparatus that forms an image on a recording medium, has a recording head provided with an ejection port that ejects ink. In recent years, images with a high quality and a high definition have been increasingly demanded, and in order to realize such images, the ejection ports of the recording heads are highly-miniaturized and have higher density. In addition, a refill frequency representing a cycle from ink ejection to the next ink ejection is set at a high level. However, if the ejection port of the recording head is highly-miniaturized, and the refill frequency is set at a high level, a great meniscus oscillation of the ink is likely to be generated at the ejection port. The great meniscus oscillation causes poor printing of images to be formed on a recording medium.

A recording head including a chip unit (recording head unit) where an ejection portion is formed, a tank holder unit that holds an ink tank, a liquid flow path forming member including a flow path, and an elastic material for sealing a liquid supply port is discussed in Japanese Patent Application Laid-Open No. 2004-122463. The tank holder unit and the flow path forming member are joined together, and a main flow path (communication passage) and a buffer chamber provided on one end portion of the main flow path are formed on a joint surface. Specifically, the buffer chamber is constructed mainly by a recessed portion of the flow path forming member which is formed on the joint surface between the tank holder unit and the flow path. Then, the buffer chamber is integrated with a through-hole that penetrates the flow path forming member. By having a gas encapsulated in advance within the buffer chamber, a pressure oscillation generated by ejection of the ink from the ejection port of the recording head, is absorbed by contraction of the gas within the buffer chamber. As a result, a meniscus oscillation is hardly generated.

At the time of the manufacture of the recording head, by running a cleaning water from the buffer chamber through the through-hole integrated with it prior to joining the recording head and the chip unit, the buffer chamber can be easily and surely cleaned. In other words, it is possible to wash out foreign matters that happen to be mixed into the buffer chamber in the course of manufacturing process of the recording head. Accordingly, a frequency of clogging the ejection port and defective ejection of the inks can be suppressed, even when foreign matters are mixed into the liquid supply path through the main flow path from the buffer chamber and carried to the ejection port after the completion of the recording head. Because the through-hole integrated with the buffer chamber is blocked when the chip unit and the flow path forming member are joined, there is no need to add a step for blocking the through-hole. Specifically, since the through-hole is blocked by the elastic material sealing a liquid supply port arranged between the flow path forming member and the chip unit, leakage of the ink from the through-hole is suppressed.

However, as illustrated in FIGS. 9A to 9C, when the recording head ejects the ink onto the recording medium, ink within a liquid supply path may flow into the buffer chamber after ejection of the ink and is pushed back by the gas within the buffer chamber. At that time, air bubbles may be added to the ink. If the gas within the buffer chamber expands to push back against the air bubbles together with the ink, gas-liquid exchange may be caused and the air bubbles enter into the liquid supply path from the main flow path. In such a case, pressure generated for ejecting the ink may be possibly absorbed by the air bubbles. In addition, the air bubbles instead of the ink may be discharged from the ejection port, thereby ink omission may possibly occur in images to be formed.

In the configuration of the recording head discussed in Japanese Patent Application Laid-Open No. 2004-122463, when the recording head ejects ink onto a recording medium, a port communicating with the through-hole of the buffer chamber is located at a bottom surface (lower side in a vertical direction) of the buffer chamber. In such a configuration, in a state where the ink is flowing into the buffer chamber, the ink enters into the through-hole through the communication port located at the bottom surface of the buffer chamber, so that the gas within the through-hole forms air bubbles in the vicinity of the communication port within the buffer chamber. By the oscillation of the recording medium during image formation, the air bubbles may possibly enter into the main flow path from the buffer, and remain within the main flow path. If the air bubbles remain within the main flow path, the air bubbles may move to the liquid supply path, while flowing into and discharging from the buffer chamber of the ink by the meniscus oscillation are repeated. Thus, the air bubbles enter into the liquid supply path and ink omission occurs in images to be formed.

SUMMARY OF THE INVENTION

The present invention is to provide a recording head having a configuration in which cleanability of the buffer chamber is high, a through-hole is blocked when assembling the recording head, and it is hard for the gas within the buffer chamber to enter into the main flow path.

According to an aspect of the present invention, a recording head that ejects ink onto a recording medium to form an image, the recording head includes a first flow path forming member and a second flow path forming member joined to each other, and a chip unit configured to eject ink supplied from the first flow path forming member via the second flow path forming member, to the outside. A flow path, a buffer chamber, and a communication passage configured to communicate between the flow path and the buffer chamber, are formed between the first flow path forming member and the second flow path forming member. A through-hole configured to penetrate the second flow path forming member to open onto a surface on an opposite side of a joint surface facing the first flow path forming member is formed on the second flow path forming member. A communication port configured to communicate with the through-hole is formed at a position facing an interior of the buffer chamber, wherein in a usage state of the recording head, the communication port is arranged at a position higher than a wall of a top surface that constitutes the communication passage.

According to the present invention, the communication port within the buffer chamber is arranged at a position higher than the wall of the top surface that constitutes the communication passage, so that even when the ink flows into the buffer chamber, it becomes harder for the ink to reach a height of the communication port. Since the ink does not reach the height of the communication port, the ink does not enter into the communication port. As a result, gas-liquid exchange does not occur between the through-hole and the buffer chamber, and thus formation of the air bubbles within the buffer chamber can be suppressed.

Even if the ink flowed into the buffer chamber reaches the height of the communication port, and enters into the communication port, air bubbles formed in the vicinity of the communication port would not enter into the communication passage since the communication port is arranged at a position higher than the wall of the top surface that constitutes the communication passage. If the air bubbles do not enter into the communication passage, the air bubbles do not enter into the main flow path and the liquid supply path that communicate with the communication passage, and as a result, the ink omission hardly appear in images to be formed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
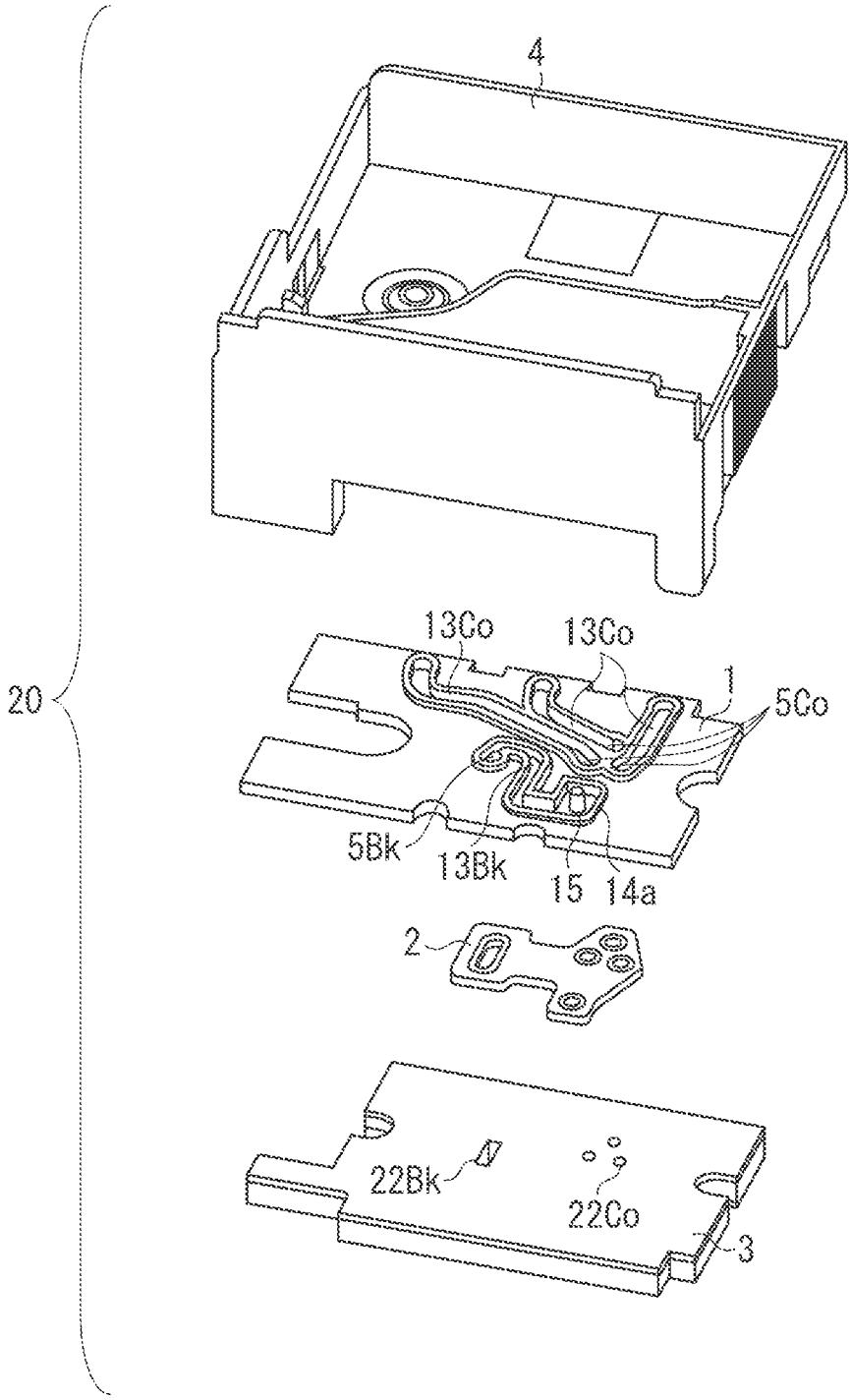
FIG. 1 is a top surface perspective view illustrating a plurality of parts that constitutes a recording head according to an exemplary embodiment of the present invention.
Figure 2:
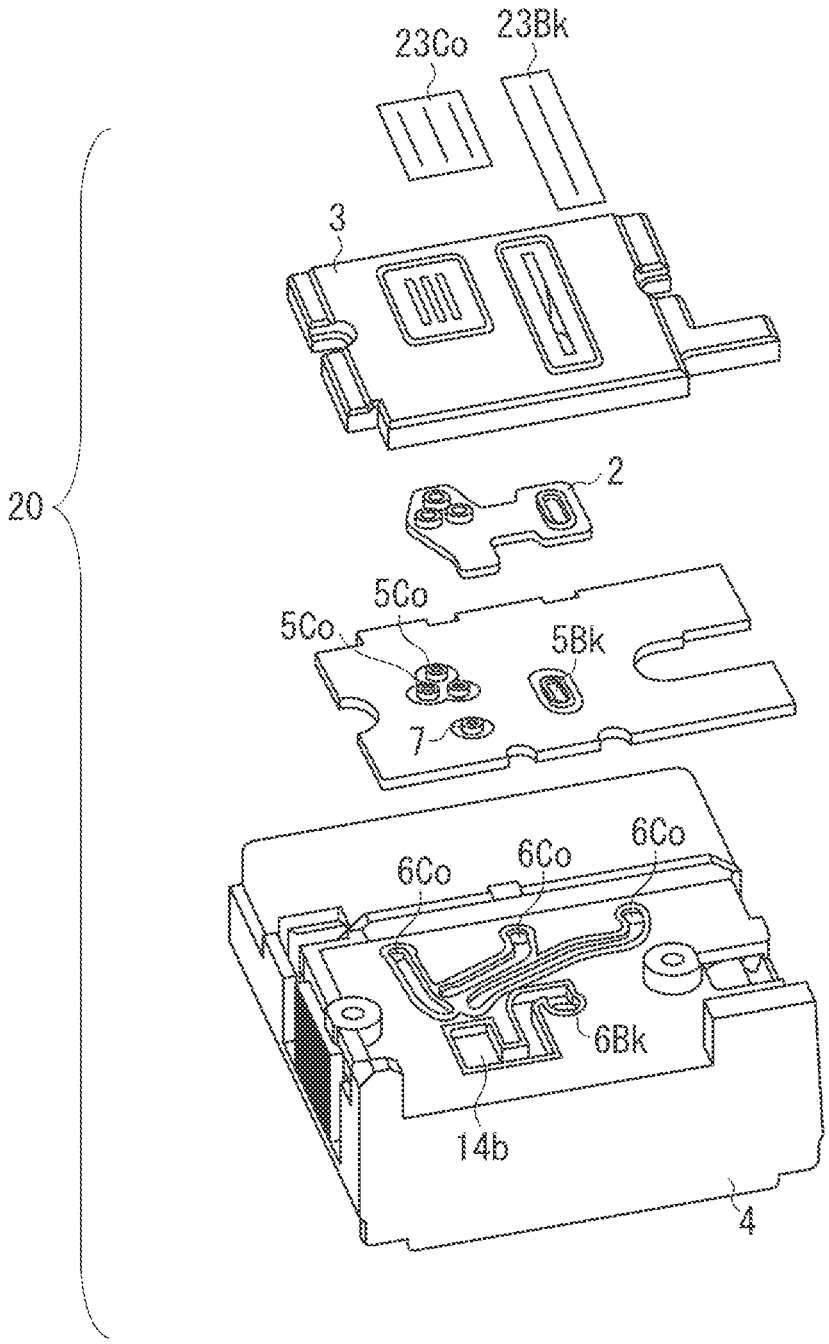
FIG. 2 is a bottom surface perspective view of FIG. 1.

FIG. 1 and FIG. 2 are a top surface exploded perspective view and a bottom surface exploded perspective view illustrating a plurality of parts that constitutes the recording head, when the recording head according to the first exemplary embodiment of the present invention is disassembled.

A recording head 20 includes a tank holder unit 4 that holds ink tanks (not illustrated) which store inks of colors such as cyan, magenta, yellow, and black. The color inks (colors) of cyan, magenta, yellow, and black pass through ink outlet ports 6Co, flow into grooves 13Co, and are supplied to an inlet portion 22Co via ink supply ports 5Co as described below from the ink tank. In a similar manner, black ink passes through an ink outlet port 6Bk, flows into a groove 13Bk, and is supplied to an inlet portion 22Bk via an ink supply port 5Bk as described below from the ink tank.

The recording head 20 includes a chip unit 3 including the inlet portions 22Bk and 22Co for introducing the inks to the ejection portions, and a flow path forming member 1 including a main flow path 9 for feeding the ink to the chip unit 3 from the ink tank and the tank holder unit 4. On a top surface side of the chip unit 3 in FIG. 2, there are provided substrates 23Bk and 23Co where ejection ports 17 (see FIGS. 4A to 4C) for ejecting the inks to positions corresponding to the inlet portions 22Bk and 22Co are formed. The flow path forming member 1 and the tank holder unit 4 are joined by ultrasonic welding.

On a joint surface between the flow path forming member 1 and the tank holder unit 4, there is provided a plurality of grooves 13 that constitutes respective main flow paths 9, and ribs are formed peripherally in the grooves 13, and these ribs are fused to become flat by ultrasonic welding of the flow path forming member 1 and the tank holder unit 4. In some of the grooves 13, there are provided ink supply ports 5Bk and 5Co for supplying the inks via the liquid supply path 16 (see FIG. 3B) to the inlet portion 22Bk and 22Co. In addition, there is provided a buffer chamber groove 14*a* that constitutes a buffer chamber 10 so as to communicate with the groove 13Bk through which especially black ink flows. In the buffer chamber groove 14*a*, there is formed a hollow truncated-cone-shaped protruded portion 15 (hollow protrusion). The hollow portion of the protruded portion 15 includes a communication port 8 located at an vertex of the protruded portion 15, and a through-hole 12 that penetrates the flow path forming member 1 from the communication port 8, and penetrates to an opening portion 7 located on the surface on the opposite side of the joint surface facing the tank holder unit 4 described below. On the joint surface that does not hold the ink tank of the tank holder unit 4, there are provided a buffer chamber groove 14*b* that constitutes the buffer chamber 10, and the ink outlet ports 6Bk and 6Co into which the inks flow from the ink tank.

A surface having the grooves 13, 14*a* and the like formed on the flow path forming member 1, and a surface having the buffer chamber groove 14*b* and the like formed in the tank holder unit 4 are subjected to ultrasonic welding, and the main flow path 9 and the buffer chamber 10 are formed on the fusion (joint) portion between the flow path forming member 1 and the tank holder unit 4. Because the main flow path 9 or the buffer chamber 10 are formed when the tank holder unit 4 and the flow path forming member 1 are joined together, the tank holder unit 4 is also referred to as a first flow path forming member, and the flow path forming member 1 as a second flow path forming member.

On each main flow path 9, there are formed the ink outlet ports 6Bk and 6Co into which the inks flow from the ink tanks, and the ink supply ports 5Bk and 5Co that supply the ink from the ink outlet ports 6Bk and 6Co to the inlet portions 22Bk and 22Co through the main flow paths 9. The main flow path 9 is formed for each color to be used. Further, the main flow path 9 is formed to stay in a horizontal position when the ink is ejected from the ejection portion of the chip unit 3, namely, in a usage state of the recording head 20.

The chip unit 3 is press-joined to the tank holder unit 4 by screw-fastening to face the other surface of the flow path forming member 1 via a supply port sealing elastic material 2 (elastic body) for preventing the leakage of the ink. In a state where the chip unit 3 is press-joined with the tank holder unit 4, the opening portion 7 located on an outer surface of the flow path forming member 1 is blocked by the supply port sealing elastic material 2, so that the through-hole 12 is blocked (see FIG. 5). Accordingly, a gas is enclosed in the interior of the buffer chamber 10, and it becomes hard for the ink to leak out from between the flow path forming member 1 and the chip unit 3.

Figure 3A:
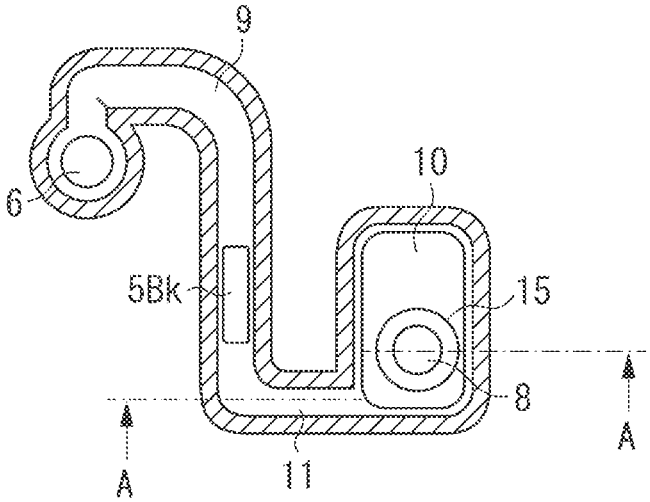
FIG. 3A is an enlarged view illustrating a buffer chamber formed between a flow path forming member and a tank holder unit provided on a recording head according to a first exemplary embodiment of the present invention.
Figure 3B:
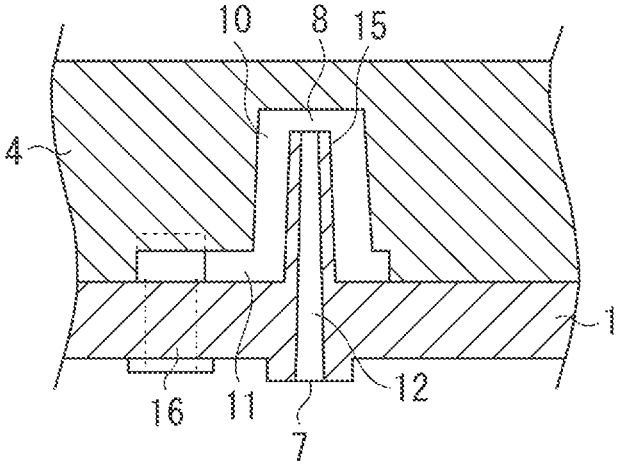
FIG. 3B is a cross-sectional view taken on line A-A in FIG. 3A.

Next, referring to FIGS. 3A and 3B, a configuration of the buffer chamber 10 provided on the recording head 20 will be described. FIG. 3B illustrates the buffer chamber 10 in the usage state of the recording head 20.

As described above, the buffer chamber groove 14*a* of the flow path forming member 1 and the buffer chamber groove 14*b* of the tank holder unit 4 are ultrasonically welded, so that the buffer chamber 10 is formed between the flow path forming member 1 and the tank holder unit 4. As illustrated in FIG. 3A, the buffer chamber 10 is provided via a communication passage 11, on one end portion of the main flow path 9 (the main flow path for black ink in the present exemplary embodiment). The hollow protruded portion 15 extends vertically from the bottom surface of the buffer chamber 10, and the communication port 8 is formed on the vertex of the protruded portion 15. A position in a vertical direction of the communication port 8 formed on the vertex the protruded portion 15 is higher than a position of the wall of the top surface that constitutes the communication passage 11. The protruded portion 15 is shaped like a hollow truncated cone, and has a shape having a cross-sectional area perpendicular to an axis of the protruded portion 15. The cross-sectional area smoothly decreases from root toward the vertex. The "top surface" or "bottom surface" refers to a top surface or a bottom surface when the recording head 20 is in the usage state.

The buffer chambers 10 may be provided with respect to each main flow path 9 for different colors other than black. Further, a volume of each buffer chamber 10 may be set depending on an amount of ejected ink. Further, joining of the flow path forming member 1 and the tank holder unit 4 may be carried out by thermal welding using laser, for example, or adhesive materials.

As illustrated in FIG. 3B, the through-hole 12 penetrates the interior of the protruded portion 15, and extends from the communication port 8 to the opening portion 7 on the outer surface of the flow path forming member 1. The opening portion 7 and the communication port 8 each are substantially of a circular shape, but an opening area of the opening portion 7 is larger than an opening area of the communication port 8. The opening area of the communication port 8 is smaller than the opening area of the opening portion 7. Accordingly, even in a case where the ink flows into the buffer chamber 10, and the communication port 8 on the vertex of the protruded portion 15 is covered with the ink, possibility that the ink may enter into the through-hole 12 can be suppressed.

The communication passage 11 and the communication port 8 that communicates with the opening portion 7 are provided in the buffer chamber 10, so that cleaning water can be run to the communication port 8 and the opening portion 7 from the communication passage 11 when assembling the recording head 20. In this configuration, foreign matters that have got mixed into the buffer chamber 10 during ultrasonically welding of the flow path forming member 1 and the tank holder unit 4 can be removed before fabricating the recording head 20. Therefore, a frequency of clogging of the ejection port 17 which causes poor ejections can be reduced. The clogging occurs when foreign matters that get mixed into the liquid supply path 16 from the ink supply port 5, pass through the main flow path 9 from the buffer chamber 10 and are carried to the ejection port 17 (see FIG. 4) after completion of the recording head 20.

A method for ejecting inks by the recording head in the above-described configuration will be described.

Figure 4A:
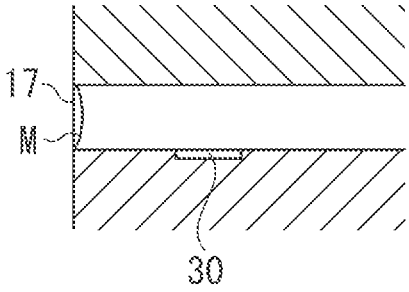
FIGS. 4A to 4C are cross-sectional views illustrating a flow in which ink is ejected from an ejection port of a general recording head.
Figure 5:
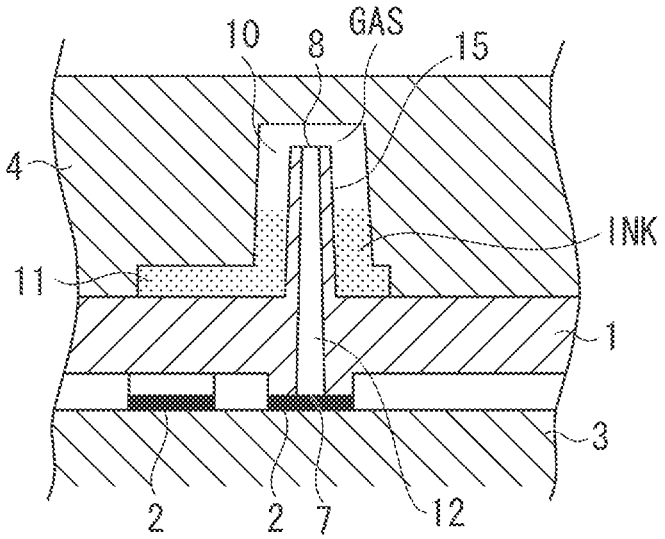
FIG. 5 is a cross-sectional view illustrating the buffer chamber formed between the flow path forming member and the tank holder unit provided on the recording head according to the first exemplary embodiment of the present invention.

The ink tank that stores ink required for forming images onto the recording medium is set to the tank holder unit 4. In this state, when appropriate suction by pressure reduction is carried out by causing a suction cap of a publicly known purge mechanism to come into contact with the chip unit 3 side, the ink stored in the ink tank flows into the main flow path 9 from the ink outlet port 6. Then, the ink fills a path from the ink supply port 5 provided in part of the main flow path 9 to the ejection port 17 via the liquid supply path 16. At the ejection port 17, as illustrated in FIG. 4A, the ink forms a meniscus M so that it is protruded toward the interior of the recording head 20. When the meniscus M is formed at the ejection port 17, the recording head 20 is prepared to form an image onto the recording medium. At this time, the gas that exists in the buffer chamber 10, as illustrated in FIG. 5, is located above the buffer chamber 10 in a state where it communicates with the through-hole 12 of the protruded portion 15. On the other hand, since the ink has flowed into lower part of the buffer chamber 10 and into the communication passage 11, even when the recording head 20 vibrates, or the gas expands due to temperature rise, the possibility that the gas pushes away the ink into the buffer chamber 10 and enters into the communication passage 11 is low.

Figure 4B:
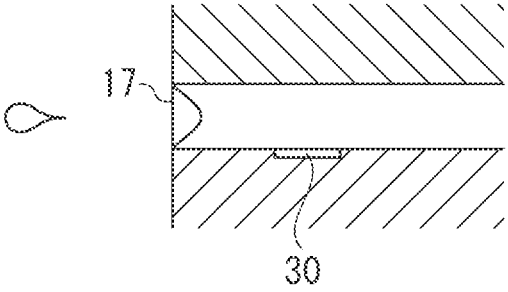
Figure 4C:
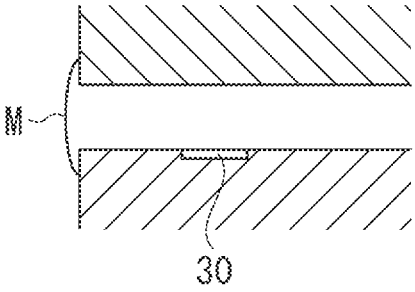

In the conventional configuration, in order to form an image on a recording medium based on input image data, as illustrated in FIG. 4B, ink is film-boiled due to heat generated by the heating element 30, and liquid droplet is ejected from the ejection port 17. Immediately after the liquid droplet has been ejected, pressure to move the ink toward the ejection port 17 becomes higher, and thus the meniscus M is protruded toward the outside of the recording head 20. Thereafter, when the pressure of the ink returns to normal, as illustrated in FIG. 4A, the meniscus M is protruded toward the interior of the recording head 20, and ejection of the next liquid droplet becomes possible. If a meniscus oscillation that changes a direction of the protrusion of the meniscus M becomes significant, there is a problem that the ink drips off without remaining at the ejection port 17 when the meniscus M is protruded toward the outside of the recording head 20.

In FIG. 4, while a surface having the ejection port 17 and a surface having the heating element 30 are arranged in directions intersecting with each other, on the chip unit 3 of the present exemplary embodiment, the substrates 23 are provided such that these two surfaces are arranged in a direction in which they go along each other. Also in the present exemplary embodiment, the problem in the above-described meniscus oscillation arises.

In the present invention, in order to deal with the problem, the buffer chamber 10 is provided, and the meniscus oscillation is suppressed by the buffer chamber 10. The gas that exists in the buffer chamber 10 can absorb the pressure of the ink generated immediately after the ejection of the liquid droplet by expansion and contraction of the gas itself.

Accordingly, even immediately after the liquid droplet has been ejected, the meniscus M becomes harder to protrude toward the outside of the recording head 20. Therefore, the meniscus oscillation is suppressed, and the ink becomes harder to drip off after the ejection of the liquid droplet.

The state of ink and gas in the buffer chamber 10 immediately after the recording head 20 including the buffer chamber 10 has ejected the ink will be described.

Figure 6A:
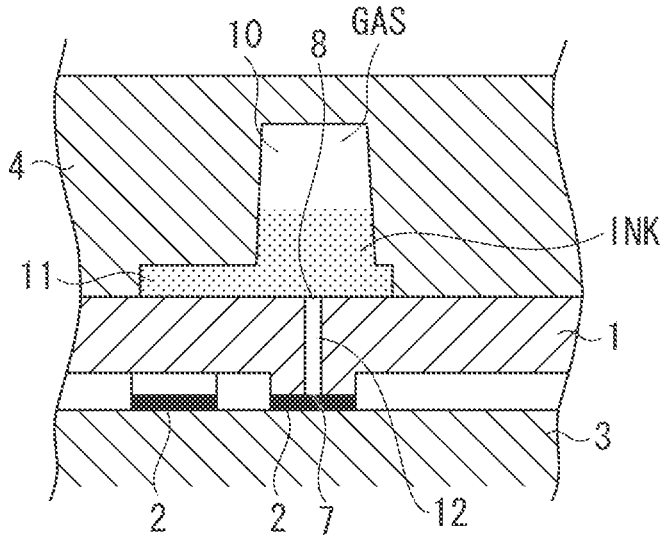
FIGS. 6A and 6B are cross-sectional views illustrating a state in which the ink flows into the buffer chamber formed between the flow path forming member and the tank holder unit provided on the recording head which is a comparative example, and air bubbles are produced from the communication port.
Figure 6B:
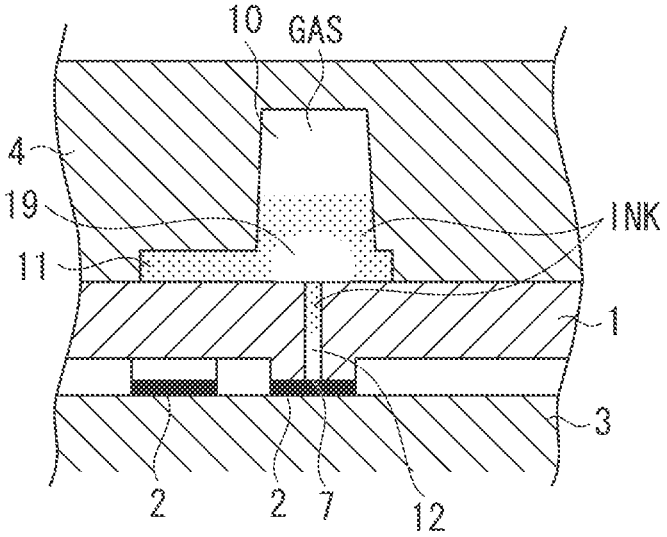

In FIGS. 6A and 6B, a buffer chamber 10 is illustrated as a comparative example in the usage state of the recording head. The buffer chamber 10 does not have the protruded portion 15, compared to the buffer chamber 10 of the present invention, and a communication port 8 communicating with the through-hole 12 is provided on the wall of the bottom surface of the buffer chamber 10, and a position thereof in a vertical direction is lower than the wall of the top surface of the communication passage 11. Therefore, the communication port 8 is covered with the ink while the chamber is filled with the ink. Accordingly, since the gas that exists in the buffer chamber 10 is located above the buffer chamber 10, the gas becomes harder to enter into the communication passage 11, even when oscillation of the recording head 20 or expansion of the gas due to temperature rise occurs.

As illustrated in FIG. 6B, if the communication port 8 is covered with the ink, the ink is subjected to gas-liquid exchange with the gas in the interior of the through-hole 12, and an air bubble 19 is produced in the ink of the buffer chamber 10 in the vicinity of the communication port 8. Typically, the produced air bubble 19 floats toward the gas above the buffer chamber 10 from the vicinity of the communication port 8 owing to buoyancy caused by the ink, and disappears together with the gas. However, in a case where the recording head 20 oscillates due to image formation, for example, the air bubble 19 possibly moves in a horizontal direction and enters into the communication passage 11 due to the oscillation before the air bubble 19 is directed upward towards the buffer chamber 10. The air bubble 19, which has entered into the communication passage 11, flows to the main flow path 9 from the communication passage 11, and finally reaches the ejection port 17. Because the ink is ejected at the ejection port 17, when the air bubble 19 is present at the ejection port 17, there is possibility that the ink might not be ejected and the ink does not impact on the recording medium, and ink omission may occur in images formed on the recording medium.

On the other hand, in the configuration of the present invention illustrated in FIG. 5, since the communication port 8 is located at the vertex of the protruded portion 15 provided on the bottom surface of the buffer chamber 10, in the usage state of the recording head 20, the communication port 8 is positioned at a high position, and the communication port 8 is not covered with the ink even when the chamber is filled with the ink. Accordingly, since the ink is not subjected to gas-liquid exchange with the gas contained in the interior of the through-hole 12, the air bubble 19 is not produced, and as a result, the ink omission in images formed on the recording medium are suppressed. Even if a filling amount of the ink is large, and the communication port 8 located at the vertex of the protruded portion 15 is covered with the ink, the air bubble 19 produced in the vicinity of the communication port 8 never enters into the communication passage 11, since the communication port 8 is arranged at a higher position than the wall of the top surface of the communication passage 11.

As described above, the communication port 8, the through-hole 12, and the opening portion 7 are provided in the buffer chamber 10 of the recording head 20, so that foreign matters that were left in an assembling step of the recording head 20 can be removed before assembling of the recording head 20 is finished. In this configuration, non-ejection of the ink from the recording head 20 is suppressed, which is caused by foreign matters moving to the ejection port 17 and blocking the ejection port 17 during formation of images.

Further, the communication port 8 is provided at the vertex of the protruded portion 15 within the buffer chamber 10, so that the ink does not block the communication port 8, and occurrence of the air bubble 19 can be suppressed. Even in a case where the ink blocks the communication port 8 and the air bubble 19 has been produced, the air bubble 19 is not likely to enter into the communication passage 11 since the communication port 8 is located at a position higher than the wall of the top surface of the communication passage 11 in the usage state of the recording head 20. Accordingly, the ink omission in the images to be formed are suppressed, since the air bubble 19 does not reach the ejection port 17 together with the ink.

Furthermore, the buffer chamber 10 can be provided utilizing a space in a vertical direction from the flow path forming member 1 to the tank holder unit 4. In this configuration, it becomes easy to arrange densely a plurality of the buffer chambers 10 corresponding to each main flow path in a limited area where the ink supply ports 5 for each color come close to each other.

Figure 7A:
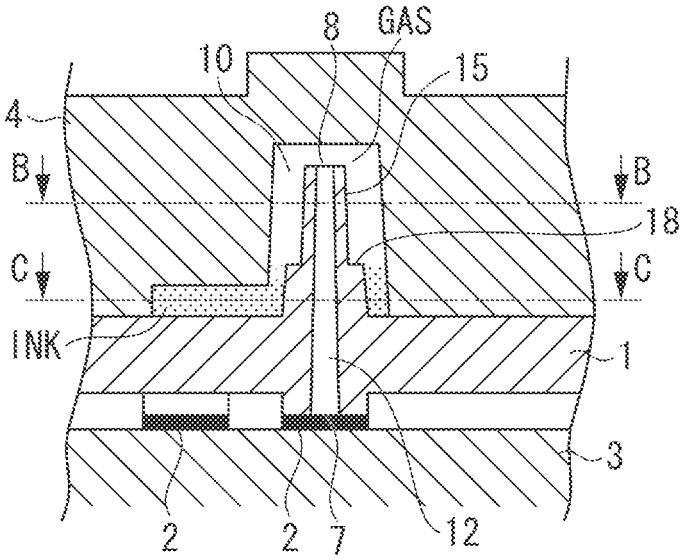
FIG. 7A is a cross-sectional view illustrating the buffer chamber formed between the flow path forming member and the tank holder unit provided on a recording head according to a second exemplary embodiment of the present invention.
Figure 7B:
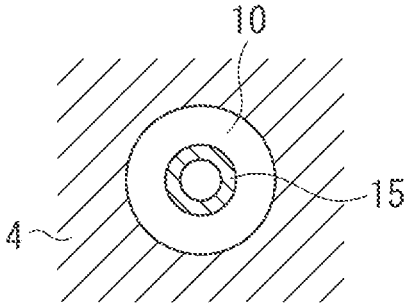
FIG. 7B is a cross-sectional view taken on line B-B in FIG. 7A.
Figure 7C:
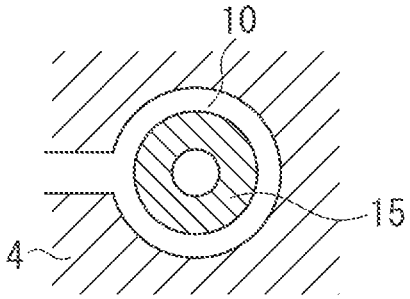
FIG. 7C is a cross-sectional view taken on line C-C in FIG. 7A.

FIGS. 7A to 7C are cross-sectional views illustrating a configuration of the buffer chamber of the recording head according to a second exemplary embodiment of the present invention.

The buffer chamber 10 is formed in a similar manner to the first exemplary embodiment, and has a circular truncated-cone-like shape. As illustrated in FIG. 7A, in the usage state of the recording head 20, the hollow protruded portion 15 extends vertically from the bottom surface of the buffer chamber 10, and the communication port 8 is formed at the vertex of the protruded portion 15. The position in a vertical direction of the communication port 8 formed at the vertex of the protruded portion 15 is higher than the position of the wall of the top surface that constitutes the communication passage 11. The protruded portion 15, as illustrated in FIGS. 7B and 7C, is formed in a shape that has a step portion 18 in such a way that vertical cross-sectional area becomes smaller in an axial direction of the protruded portion 15 in an intermediate region from the root of the protruded portion 15 towards the vertex. In the intermediate region a smaller hollow truncated cone is stacked on a hollow truncated cone. In other words, the protruded portion 15 has such a shape that a lower region of the protruded portion 15 is thicker, and an upper region becomes thinner across the boundary of a step portion 18. The hollow section of the protruded portion 15 includes the communication port 8, the through-hole 12, and the opening portion 7.

The protruded portion 15 has the step portion 18, so that a cross-sectional area of the buffer chamber 10 perpendicular to the axis line of the protruded portion 15 increases sharply across the boundary of the step portion 18, when the ink is suctioned by pressure reduction. As a result, ink that flows into the buffer chamber 10 becomes harder to flow into the buffer chamber 10, when liquid surface goes over the step portion 18. Then, when filling of the ink is completed and pressure reduction is discontinued, the ink flowed into the buffer chamber 10 is at a level of the step portion 18 of the protruded portion 15. In the above configuration of the protruded portion 15, even when significant negative pressure is applied for the suction by pressure reduction, a large amount of the ink becomes harder to rapidly flow into the buffer chamber 10. As a result, a volume of the gas contained in the buffer chamber 10 can be stabilized.

Further, as illustrated in FIG. 7A, on the tank holder unit 4 that forms the buffer chamber 10, a protruded portion 21 is provided on the outer surface of the tank holder unit 4 that is close to the wall of the top surface of the buffer chamber 10. The protruded portion 21 is provided to enhance sealing property for the gas above the buffer chamber 10 by widening a spacing between the outer surface of the tank holder unit 4 and a wall surface of the top surface of the buffer chamber 10, so that possible fluctuation of gas volumes within the buffer chamber 10 is reduced in a case where a long period of time has passed.

The configuration of other recording heads and the method for ejecting inks are similar to those in the first exemplary embodiment and therefore description thereof will not be repeated.

As described above, the step portion 18 is provided on the protruded portion 15 such that a cross-sectional area perpendicular to the axis of the protruded portion 15 becomes smaller. In this configuration, significant negative pressure can be applied to perform suction by pressure reduction at the time of ink filling. Therefore, time required for the ink filling can be shortened, and images can be formed on the recording medium at a higher speed.

Figure 8:
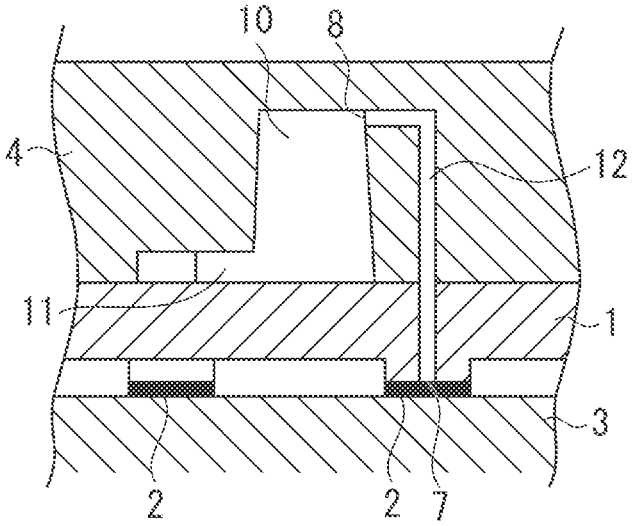
FIG. 8 is a cross-sectional view illustrating the buffer chamber formed between the flow path forming member and the tank holder unit provided on a recording head according to a third exemplary embodiment of the present invention.
Figure 9A:
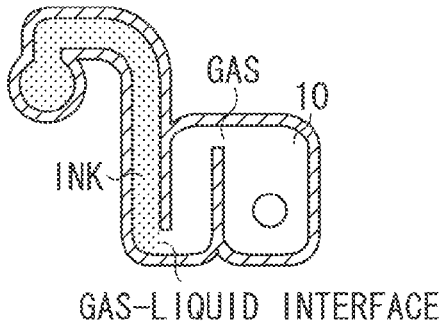
FIG. 9A PRIOR ART
FIGS. 9A to 9C are cross-sectional views each illustrating a flow in which air bubbles enter from the buffer chamber into a main flow path provided on a recording head based on the conventional technology.
Figure 9B:
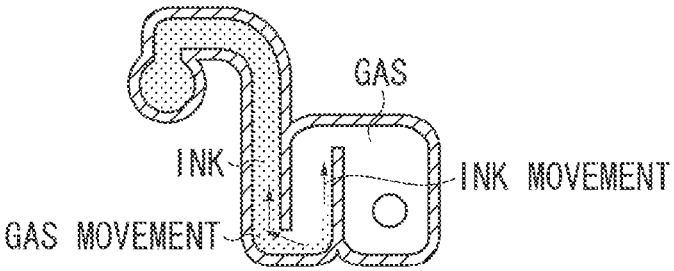
FIG. 9B PRIOR ART
Figure 9C:
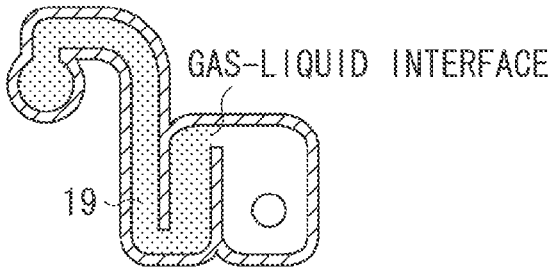
FIG. 9C PRIOR ART

FIG. 8 is a cross-sectional view illustrating a configuration of a buffer chamber provided on a recording head according to a third exemplary embodiment of the present invention.

The buffer chamber 10 is formed similar to the conventional form, and does not have a protrusion. The communication port 8 that communicates with the outer surface of the opening portion 7 of the flow path forming member 1 is provided on a wall of side surface that constitutes the buffer chamber 10, so as to come close to the wall of the top surface that constitutes the buffer chamber 10. The through-hole 12 is formed between the opening portion 7 and the communication port 8.

Other configurations of the recording head and methods for ejecting inks are similar to those in the first exemplary embodiment and therefore descriptions thereof will not be repeated.

As described above, the communication port 8 is provided at a higher level than the wall of the top surface of the communication passage 11, and close to the wall of the top surface of the buffer chamber 10. Accordingly, the communication port 8 is not covered with the ink even when the ink flows into the buffer chamber 10, so that occurrence of the air bubble is suppressed. Since the air bubbles do not occur, the ink omission in the images to be formed is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-019353 filed Feb. 4, 2013, which is hereby incorporated by reference herein in its entirety.

What is claimed is:

1. A recording head for ejecting ink, the recording head comprising:

an ejection portion configured to eject ink;

a first flow path forming member; and a second flow path forming member provided on a lower side of the first flow path forming member in a configuration where in a usage state of the recording head, air bubbles are suppressed due to the positioning of the second flow path member, wherein the first flow path forming member and the second flow path forming member are joined to each other, between which a flow path for supplying ink to the ejection portion, a buffer chamber for keeping gas, and a communication passage communicating between the flow path and the buffer chamber, are formed;

wherein the first flow path forming member is provided with a recessed portion forming a part of the buffer chamber;

wherein the second flow path forming member is provided with a protruded portion protruding into the buffer chamber, and a through-hole penetrating the second flow path forming member is formed inside the protruded portion, and wherein a communication port being an end on a buffer chamber side of the through hole is arranged at a position higher than a wall of a top surface that constitutes a communication passage in a usage state of the recording head.

2. The recording head according to claim 1, wherein the protruded portion is a hollow protrusion.

3. The recording head according to claim 2, wherein a hollow section of the hollow protrusion includes the through-hole and the communication port that communicates with the through-hole.

4. The recording head according to claim 2, wherein the hollow protrusion has a step portion across which a cross-sectional area perpendicular to an axial direction of the hollow protrusion becomes smaller, and the step portion is arranged at a position higher than a wall of a top surface that constitutes the communication passage in a usage state of the recording head.

5. The recording head according to claim 1, wherein the communication port is provided on a wall of a side surface that constitutes the buffer chamber, in such a way as to come close to a wall of a top surface that constitutes the buffer chamber in a usage state of the recording head.

6. The recording head according to claim 1, wherein an elastic body is provided between the ejection portion and the second flow path forming member and is configured to block the through-hole.

* * * * *